US005170837A

United States Patent [19]

Gaspar

[11] Patent Number: 5,170,837

[45] Date of Patent: Dec. 15, 1992

[54] TWO PART HEARTH

[75] Inventor: Thomas Gaspar, Bexley, Ohio

[73] Assignee: Ribbon Technology Corporation, Gahanna, Ohio

[21] Appl. No.: 754,038

[22] Filed: Sep. 3, 1991

[51] Int. Cl.[5] ..... B22D 11/06

[52] U.S. Cl. ..... 164/429; 164/337

[58] Field of Search ..... 164/423, 463, 429, 479, 164/136, 337

[56] References Cited

U.S. PATENT DOCUMENTS 4,112,998 9/1978 Sato ..... 164/136

4,907,641 3/1990 Gaspar ..... 164/423

*Primary Examiner*—Kuang Y. Lin

*Attorney, Agent, or Firm*—Frank H. Foster

[57] ABSTRACT

A two part, integrated melt overflow pouring apparatus including a hearth which contains molten material, and a spout which is stationary with respect to, and transfers the liquid to, a rotating, heat extracting substrate such as a drum. A hinging body such as a cylinder connects the hearth and the spout and allows the hearth to rotate with respect to the spout. A channel is formed in the cylinder and an equal width channel is formed in the spout. The floor of the channel in the hinging body is at a 45° angle with horizontal initially and rotates when the hinging body rotates. The hearth is rotated about the axis of the hinging body, the molten material flows out of the hearth through the channel in the hinging body, through the channel in the spout and solidifies against the drum.

13 Claims, 5 Drawing Sheets

TWO PART HEARTH

TECHNICAL FIELD

This invention relates to the field of melt overflow processes for the rapid solidification of molten material, and more specifically relates to a means for transferring molten material to a substrate on which the material is cast.

BACKGROUND ART

The melt overflow process typically includes a molten material that is contained within a hearth which is a refractory lined furnace which has four sides, one of which has at least a portion with a top edge which is lower than the upper surface of the molten material. A rotating, heat extracting substrate, such as a water cooled drum, is placed in very close proximity to the hearth in the region where the one wall is lower than the surface of the molten material. The drum is rotated and the molten material cools and freezes against the surface of the drum, and the solidified material adheres to the drum and "rides" the drum upward and over the top of the drum. In this process fibers or a continuous strip of solidified material is formed directly from molten material.

One problem that exists with this melt overflow process is the difficulty in emptying all of the molten material out of the hearth. It is also difficult to maintain a constant circumferential height of molten material in contact with the rotating drum throughout the overflow process. It is necessary to keep the height of material in contact with the drum constant in order to maintain a uniform thickness in the finished strip or fiber.

In U.S. Pat. No. 4,907,641, Gaspar pivotally attaches a hearth to pivot about the axis of the conventional rotating drum. The hearth, filled with molten material, is then rotated about the axis of the drum and slowly poured onto the drum, overflowing over one edge of the hearth. The edge of the hearth over which the liquid flows maintains a constant radial distance from the outer surface of the drum, thereby avoiding both contact with, and possible damage to, the drum and excessive spacing from the drum.

That apparatus has disadvantages which include the inability to utilize 100% of the molten material in the hearth. Up to half of the molten material remains in the hearth and is not formed into a finished product. Additionally, since the thickness of the solidified product is dependent upon the amount of liquid which is in contact with the drum, and since the hearth rotates about the axis of the drum, the thickness of the final product is initially a function of the height of the pool of liquid in contact with the drum when the hearth is positioned directly to the side of the drum, and then becomes dependent on both the height of the liquid and the angle of the hearth relative to its initial horizontal position. This is due to the changing length of circumferential surface of the drum which the liquid contacts as the hearth rotates around the drum.

Other conventional methods for avoiding problems experienced with the melt overflow process include pivoting the hearth about the point of contact between the rotating drum and the molten material. In many melt overflow processes, a "skull" of solidified material is formed at the lip of the hearth over which the liquid flows. Any rotation of the hearth would cause this skull to contact, and possibly damage, the outer surface of the drum. One way to avoid this contact is to dump a crucible of molten material into a smaller container which is stationary with respect to the axis of the drum. In this case, however, there is a great deal of turbulence created in pouring liquid from one container into the second one.

Therefore, the need arises for an apparatus which extracts most, if not all, of the molten material from the hearth, maintains a constant amount of liquid in contact with the drum, maintains a constant critical distance between the element conveying the liquid to the drum and the outer surface of the drum, and which does not create appreciable turbulence in the liquid during pouring.

BRIEF DISCLOSURE OF INVENTION

This invention relates to a melt overflow apparatus in which a spout for holding molten material has a portion of one wall removed. This causes the material to overflow out of the spout onto a rotating, heat extracting substrate. The substrate is positioned laterally with respect to the spout and is positioned in the region where a portion of the spout wall was removed. The invention is an improved melt overflow apparatus comprising a stationary spout which has a channel formed through it. One open end of the channel is adjacent to the outer surface of the substrate, the substrate confining the molten material and preventing it from flowing downwardly out of the end of the channel in the spout. The overflow apparatus further includes a hinging body, one side of which engages the spout at the opposite end of the channel, and a hearth which also engages the hinging body. The hearth is pivotable about the hinging body with respect to the stationary spout. The hinging body can be fixed to either the stationary spout or the rotatable hearth or it can be a free third member. The hinging body has an arcuate surface which is engaged by a mating arcuate surface on the rotatable hearth or the stationary spout or both.

Figure 1:
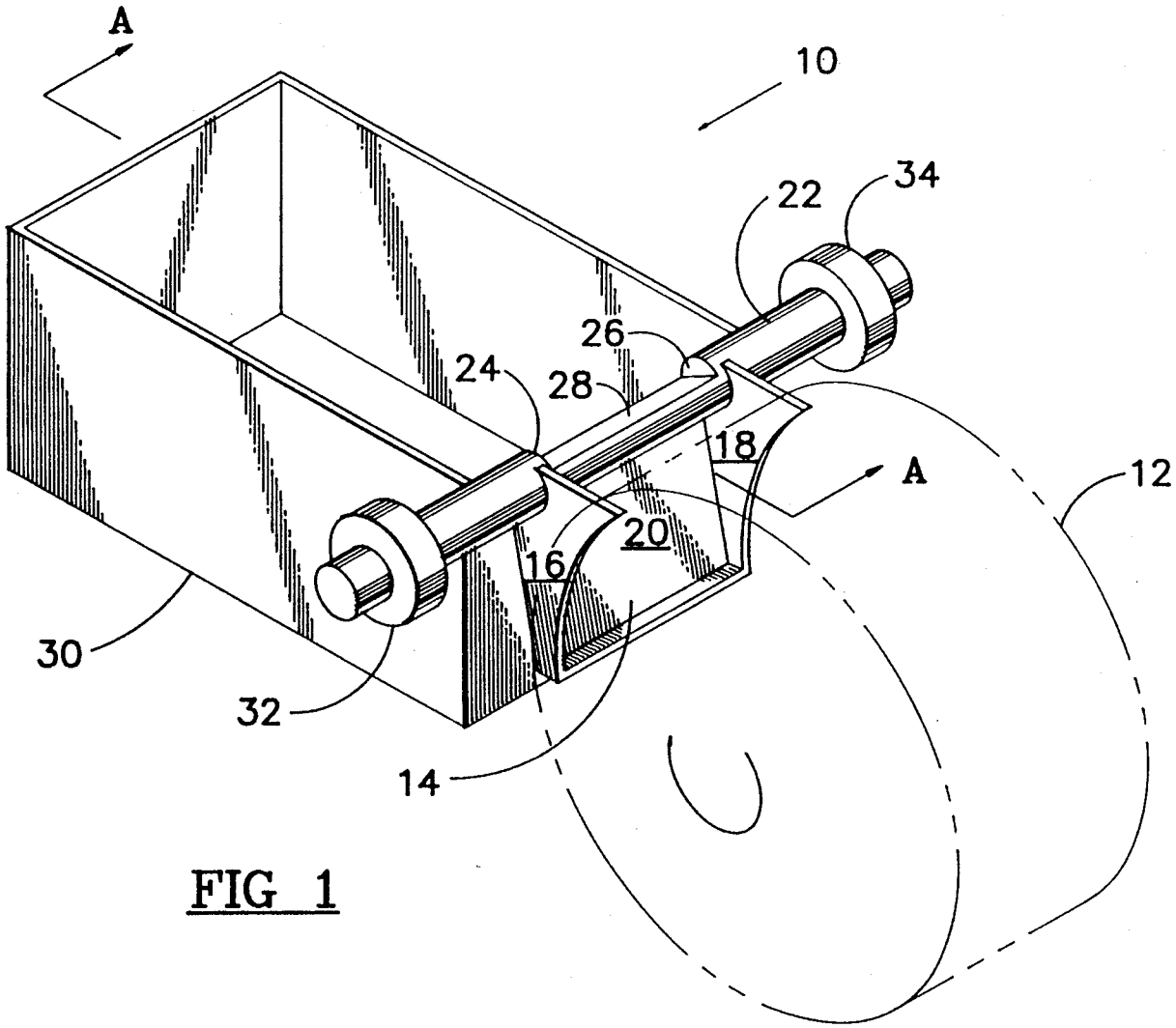
FIG. 1 is a view in perspective illustrating the preferred embodiment of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

The preferred apparatus 10 is illustrated in FIG. 1 and is shown laterally disposed of and in close proximity to a conventional rotating, heat extracting drum 12, shown in phantom. The apparatus 10 includes a spout 14 having parallel sidewalls 16 and 18. The sidewalls 16 and 18 form a channel through the spout 14 which directs the molten material against the outer circumferential surface of the drum 12 and are higher than the level of molten material to prevent overflow over the sidewalls 16 and 18. The spout 14 also has a floor 20 which connects, and is generally perpendicular to, the sidewalls 16 and 18. The floor 20 is preferably inclined at 45° with respect to horizontal to promote fluid flow to the bottom of its upper surface and to allow for a "skull" of solidified material to form during the overflow process without the skull interfering appreciably with fluid flow down the floor 20.

The sidewalls 16 and 18 and the upper portion of the floor 20 have a concave, cylindrical surface formed in them at the end of the channel opposite the drum 12, to accommodate a hinging body, preferably a cylinder 22. The convex outer surface of the cylinder 22 matingly engages with the concave, cylindrical surface of the spout 14. In the preferred embodiment, the cylinder 22 is slidingly rotatable within the concave surface of the spout 14 and pivots about its axis.

The cylinder 22 has a portion of material near its central region removed forming sidewalls 24 and 26 and floor 28. The sidewalls 24 and 26 and the floor 28 form a channel, the floor 28 of which is essentially along a diameter of the cylinder 22 if seen in section along the axis of the cylinder 22. That is, between the sidewalls 24 and 26 where the channel is formed, substantially half of the cylinder 22 has been removed forming a flat plane along the axis of the cylinder 22.

A hearth 30, preferably water cooled copper, having four sidewalls and a bottom is rigidly attached to the cylinder 22 and its sidewalls extend from the floor of the hearth to the top of the cylinder 22 in the preferred embodiment. The hearth 30 pivots about the axis of the cylinder 22.

The cylinder 22 has coaxial bearings 32 and 34 located outwardly of the channel region of the cylinder 22 and the sidewalls of the hearth 30. The bearings 32 and 34 have internal cylindrical surfaces upon which the cylinder 22 slides and is rotatable.

The function of the apparatus 10 is as follows. Referring to FIG. 1, the hearth 30 contains molten material which, as the hearth 30 is driven upwards and pivoted about the axis of the cylinder 22 by rotating the cylinder 22, overflows over the floor 28 and flows through the channel formed in the cylinder 22 and into the channel formed in the spout 14. The molten material flows between the sidewalls 24 and 26 formed in the cylinder 22, and between the sidewalls 16 and 18 formed in the spout 14. The sidewalls 24 and 26 in the cylinder 22 are substantially the same distance from each other as the sidewalls 16 and 18 of the spout 14. This constant width path through the channels reduces turbulence because there is no divergence or convergence of the liquid as it exits one container or channel and enters another. Since the drum 12 is rotating clockwise as shown by the arrow in FIG. 1, as the liquid fills the spout 14 and contacts the drum 12, it solidifies and adheres to the drum 12 in the conventional manner.

Without the channel formed in the cylinder 22, the liquid would overflow over the top of the cylinder 22. To keep the liquid from flowing over the sides of the hearth 30 and the spout 14, there would need to be walls, higher than the top of the cylinder 22 and extending from the hearth 30 and spout 14, which would slidingly interface as the hearth 30 is tilted. However, a "skull" of solidified liquid would form on the slidingly interfacing walls and the sliding surfaces would bind against the skull formed on their surfaces.

Figure 2:
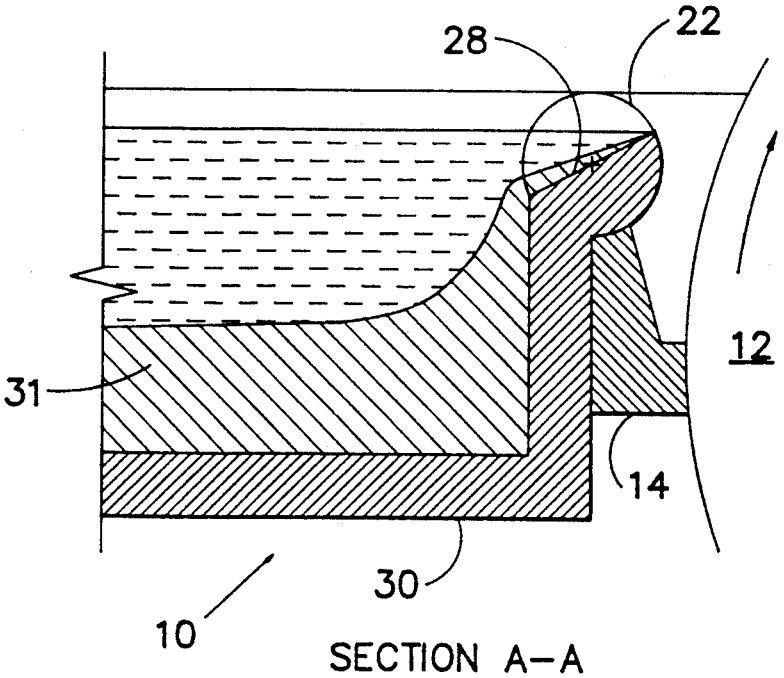
FIGS. 2, 3 and 4 are side views in section illustrating the preferred embodiment of the present invention in three subsequent positions in the overflow process.
Figure 3:
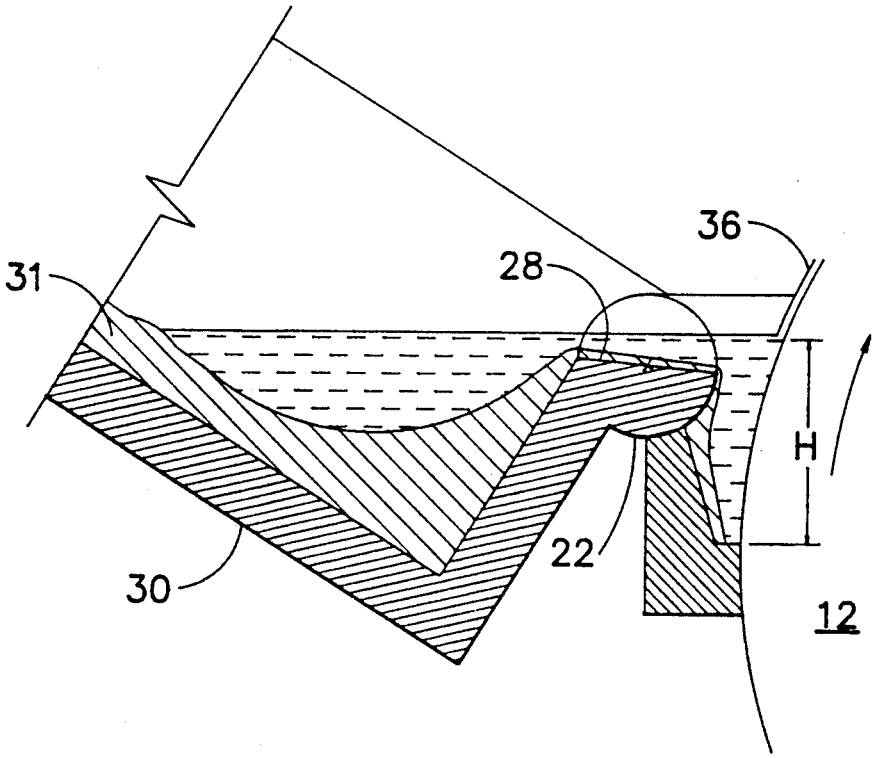

Referring to FIG. 2, the apparatus 10 of FIG. 1 is shown in section through its center along the line A-A. The hearth 30 is filled with molten material up to the top edge of the channel of the cylinder 22. A skull 3 of solidified material forms along the interior surface of the hearth 30. As the hearth 30 is tilted upwards as shown in FIG. 3, the molten material flows into the spout 14 and quickly fills it to some height H. The levels of the molten material in the hearth 30 and spout 14 are equilibrated when the height H is reached and, by further tilting the hearth 30, remain at equilibrium until the end of the process. The drum 12 is turning clockwise as shown by the arrow in FIG. 3, and the molten material which contacts the drum 12 solidifies and forms a strip 36 which adheres to the drum 12 and is carried upward. The level H is a function of the rate material is removed from the spout 14 by solidification and the rate material is added to the spout 14 from the hearth 30. The rate material is added into the spout 14 is controlled by the rate of tilting of the hearth 30. The height H is maintained at a constant value by controlling the rate at which the hearth 30 is tilted upwards and therefore controlling the rate of overflow into the spout 14. The hearth 30 is preferably tilted a total of approximately 30° from its initial position.

During the pouring process, the effective depth of the channel of the cylinder 22 through which the molten material flows varies. The effective depth of the channel is defined as the vertical distance from the top of the side wall of the cylinder 22 to the highest region of the floor 28 in the illustration. The effective depth of the channel is at a minimum before the material first starts to overflow and then reaches a maximum when the floor 28 of the channel is parallel to the top surface of the molten material. The depth of the liquid in the channel is not necessarily also at a maximum at this point since the depth of the liquid in the channel may vary for a particular effective channel depth. The effective depth of the channel is not affected by the depth of the liquid in the channel since the effective depth of the channel is a mechanical function of the angle of the floor 28 of the channel. The depth of the liquid in the channel is, however, affected by the effective depth of the channel since the liquid may only be as deep as the channel, as any greater depth would cause overflow over the sidewalls 24 and 26. At the end of the overflow, the effective depth of the channel again reaches a minimum. Because of this changing effective depth of the channel, the floor 28 of the cylinder 22 acts somewhat like a valve which opens and closes when going from its minimum depth to its maximum depth and back to its minimum depth again during the overflow process.

Figure 8:
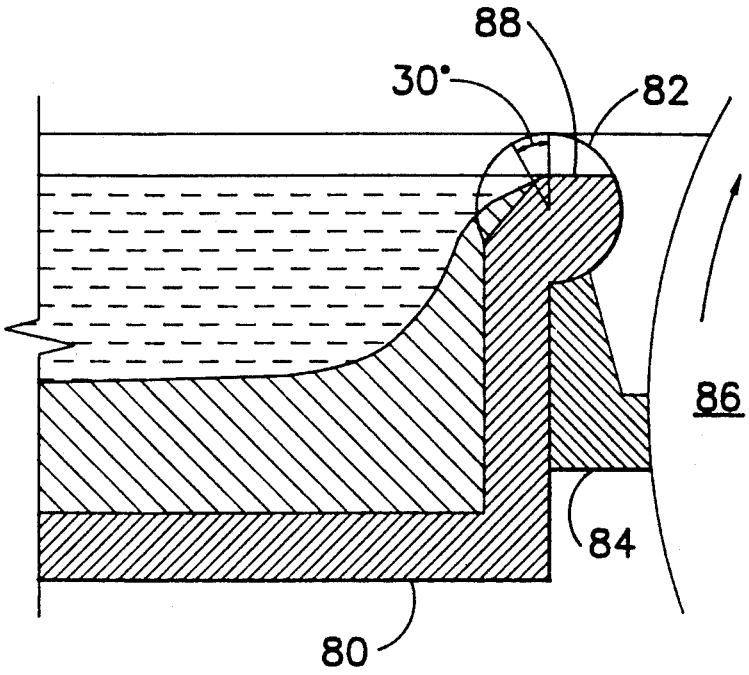
FIG. 8 is a view in vertical section illustrating an alternative embodiment of the present invention.

FIG. 8 is a side view in section of an alternative embodiment and illustrates the concept of channel depth. A hearth 80 has a cylinder 82 rigidly attached to it and the cylinder 82 rotatably engage a spout 84 which is laterally disposed with respect to a drum 86, as in the preferred embodiment. This embodiment differs from the preferred in floor 88 of the channel formed in the cylinder 82. The floor 88 has an arcuate middle region which subtends an angle of 30°, and two planar regions which extend tangentially from opposite ends of the arcuate middle region to the outer edge of the cylinder 82. As the hearth 80 is rotated through an angle of 30°, the depth of the channel in the cylinder 82 is unchanging through the entire 30° tilt. This is because the arcuate region of the floor 88 has its axis along the axis of the cylinder 82 and therefore the distance between the arcuate region of the floor 88 and the uppermost edge of the cylinder 82 does not change throughout the entire 30° tilt of the hearth 80. If the hearth 80 is tilted beyond 30°, the depth of the channel decreases, thereby decreasing the potential depth the liquid can attain in the channel.

Referring again to the preferred embodiment in FIG. 3, before the end of the pouring process, the floor 28 of the channel should not rise above the top surface of the molten material in the spout 14. If this occurs, further tilting of the hearth 30 will cause the molten material to flow rapidly over the floor 28 through the channel like a waterfall, possibly creating turbulence when it flows down into the pool of liquid in the spout 14, which is undesirable. Therefore, the hearth 30, in FIG. 3, has nearly reached its final position, as any more tilting will cause the floor of the channel, which actually comprises the skull 31 which has solidified on the floor 28, to extend through the top surface of the liquid.

Figure 4:
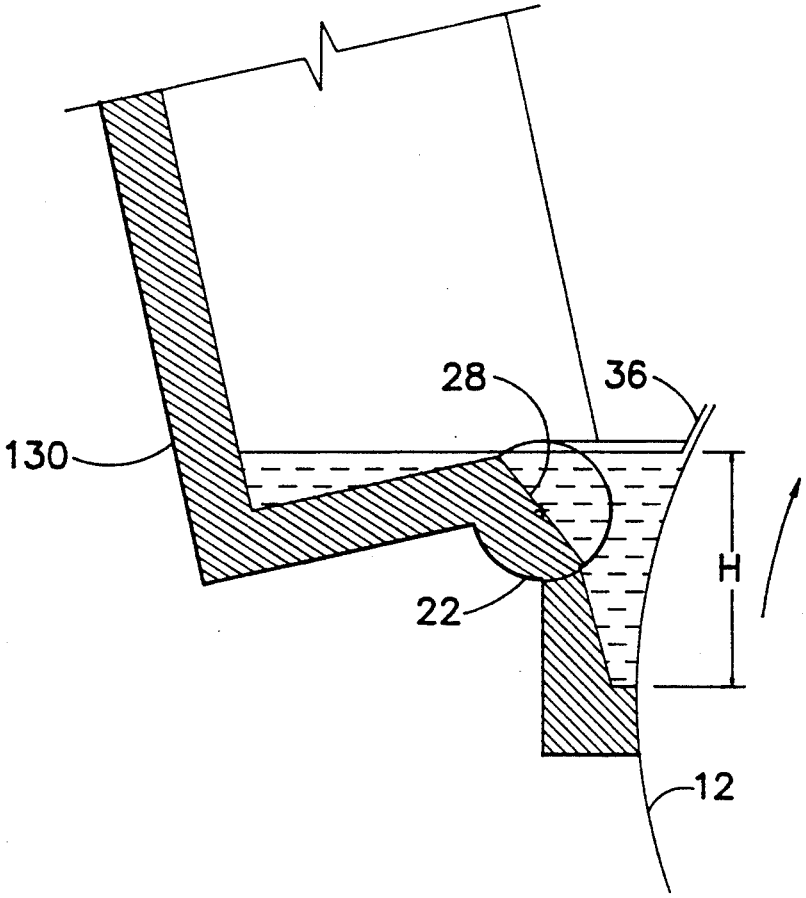

FIG. 4 shows a possible near final position of a hearth 130 which has no skull formed. The hearth 130 can potentially be rotated to this position and beyond if desirable and the skull may be eliminated by, for example, using a refractory metal to form the hearth 130 and heating the melt metal through the entire pour, causing any skull that forms to melt and pour out.

During the pouring of the molten material into the spout 14 from the hearth 30, a "skull" of solidified material may form at the end of the channel in the spout 14 which is nearest the cylinder 22. However, since the material shrinks as it freezes, it pulls slightly away from the cylinder 22 leaving a small gap. Because the cylinder 22 rotates about its own axis, the radial distance from its outer surface to its axis never changes. Therefore, the outer surface of the cylinder 22 never moves toward the spout 14 to close the gap and contact the skull which could cause damage to or binding of the cylinder 22 and therefore, the hearth 30.

Additionally, during pouring of the molten material into the spout 14, a skull may form at the end of the channel in the spout 14 nearest the drum 12. The spout 14 is stationary with respect to the axis of the rotating drum 12 and therefore, the skull is never moved radially closer to the outer surface of the drum 12 which could possibly cause damaging contact with or binding of the rotating drum 12.

Referring again to FIG. 2, as the molten material is poured into the spout 14, because the sidewalls 16 and 18 of the spout 14 are generally co-planar with the sidewalls 24 and 26 of the channel formed in the cylinder 22, the molten material is not forced to spread out into the spout 14 as is the case with a narrower nozzle or spout. Additionally, once the molten material overflows from the hearth 30 and enters the channel of the cylinder 22, it is essentially the same width as it will be in its final solidified form. That is, the molten material overflows out of the hearth 30, into the channel in the cylinder 22 where it attains a certain width. The width of this stream of material is not appreciably changed when it flows into the spout 14 and it is also not appreciably changed from the time it contacts the drum 12 until it solidifies.

When the molten material is initially being poured into the spout 14 from the hearth 30, the flow is more turbulent than when the steady state pouring occurs after the molten material rises to the height H as shown in FIGS. 3 and 4. However, because the molten material is poured through a series of channels, it never loses contact with a lower supporting plane such as the floor 28. In conventional two part, non-integral pouring apparatuses, turbulent flow occurs due to a waterfall effect from the molten material not being constantly supported. That is, the molten material experiences a free-fall which is suddenly interrupted by its impact onto a support surface. The turbulence created by the present invention is small initially and then subsides once the level H is attained. Turbulence is prevented due to the steady, even tilt of the hearth 30 for maintaining a continuous top liquid surface across the hearth 30, cylinder 22 and spout 14, and constant support under the liquid preventing a free fall with a subsequent impact onto a support surface. In a conventional two part pouring apparatus, turbulence occurs constantly throughout the entire pouring process.

Turbulence in the molten material is undesirable since it creates temperature fluctuations and non-uniform fluid flow in the material near the heat extracting drum which could result in imperfections in the solidified product. Turbulent flow of molten material also causes waves which vary the height of material in contact with the drum, making it difficult to maintain a product of uniform thickness.

The floor 28 of the channel formed in the cylinder 22 which is shown in FIGS. 2, 3 and 4 is, in the preferred embodiment, oriented substantially along a diameter of the cylinder 22. In the preferred embodiment, the angle of the floor 28 of the channel is oriented at approximately a 45° angle with respect to horizontal in its initial position. This is the preferred angle of orientation because as the hearth is then rotated through a potential tilt of approximately 90°, (from a horizontal position to a vertical position during the pouring of the molten material into the spout 14), the floor 28 of the channel formed in the cylinder 22 also rotates 90° and becomes co-planar with the floor 20 of the channel formed in the spout 14. The floor 20 of the channel formed in the spout 14 is, of course, also approximately at a 45° angle with horizontal.

Figure 5:
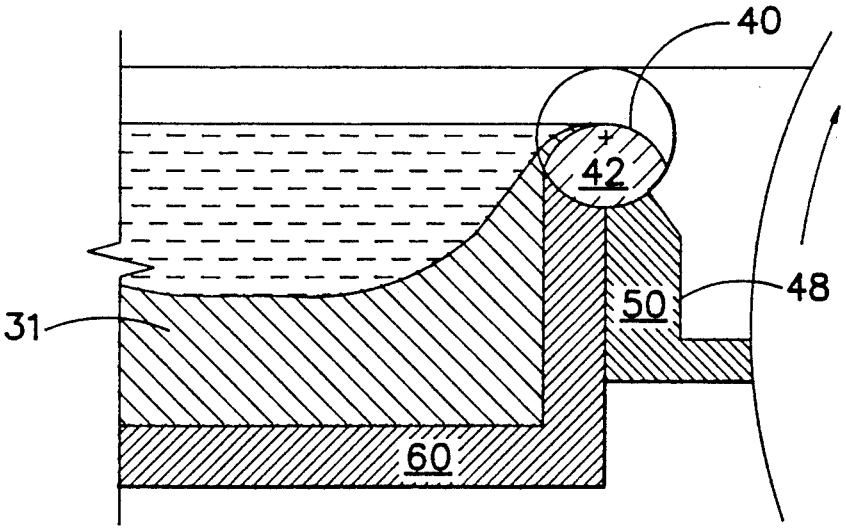
FIG. 5 is a view in vertical section illustrating an alternative embodiment of the present invention.
Figure 6:
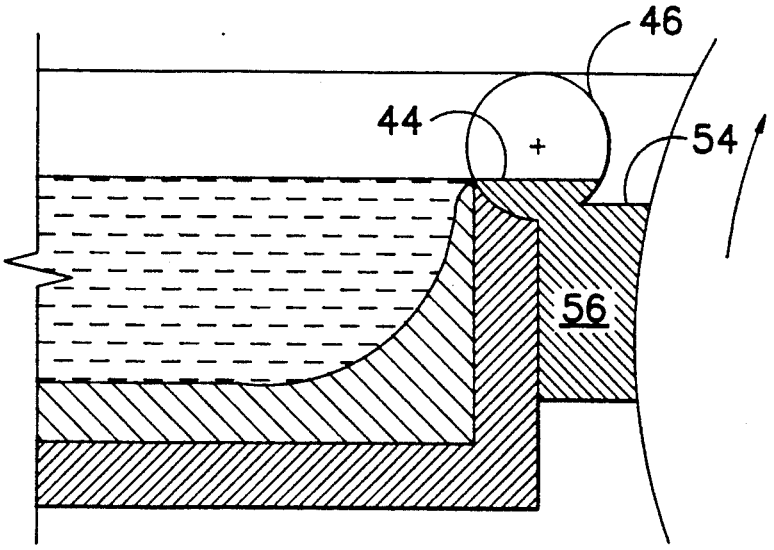
FIG. 6 is a view in vertical section illustrating an alternative embodiment of the present invention.

It is possible to use different shapes of the floors of channels formed through a cylinder. For example, instead of the floor of the channel being oriented along a diameter of the cylinder as in the preferred embodiment when the cylinder is seen in section, a floor 40 of a channel may be oriented along an arc connecting two sides of a cylinder 42 in section as is shown in FIG. 5. Additionally, a floor 44 of a channel may be a plane which is not along a diameter, as shown in FIG. 6. The floor 40, in FIG. 5, preferably should not rotate beyond the floor 48 of the spout 50 as this will create a crevice in which a skull of solidified material may form causing the cleanup of the device to be very time consuming and expensive.

FIGS. 5 and 6 also illustrate some alternative shapes of floors of channels in spouts. For example in FIG. 5, floor 48 of spout 50 is angled near the cylinder 42, but then is horizontal forming a step near the bottom of the spout 50 by a drum 52. In FIG. 6, floor 54 of the channel in a spout 56 is completely horizontal rather than angled or step-like.

In addition to variations in the shapes of the floors of the channels, the hinging body may be attached to a hearth 30 as in FIG. 2 (which is the preferred embodiment), the spout 56 as in FIG. 6, or rotatable with respect to a hearth 60 and the spout 50 as in FIG. 5. With the cylinder 46 rotatable with respect to the hearth 60 and the spout 56 as shown in FIG. 5, the cylinder 46 may be controllably rotated with respect to both the hearth 60 and the spout 56, or may be controlled to rotate with respect to only one and remain stationary with respect to the other.

Figure 7:
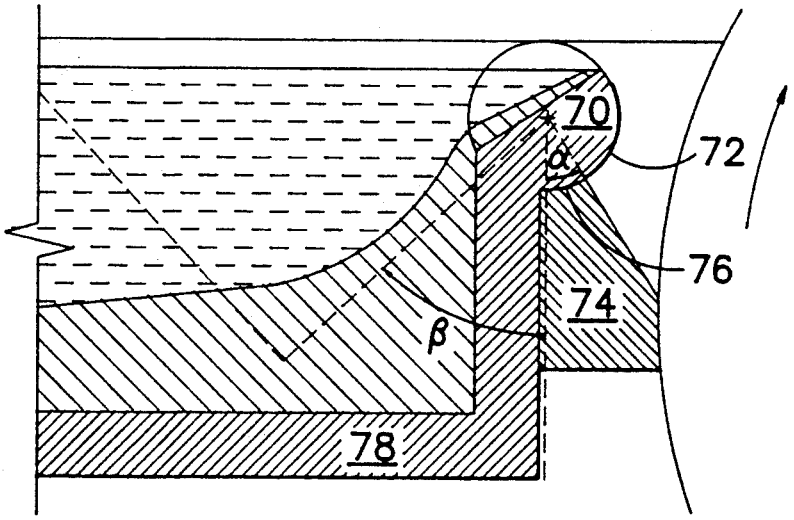
FIG. 7 is a view in vertical section illustrating an alternative embodiment of the present invention illustrating the total angle of the cylindrical surface on the hinging body.

Referring to FIG. 7, a hinging body 70 having a convex, cylindrical outer surface 72 interfaces with a spout 74 having a concave, cylindrical outer surface 76. In the preferred embodiment, the hinging body 70 is a cylinder having a convex, cylindrical outer surface around its entire circumference. However, it is possible to have a hinging body 70 which has a cylindrical outer surface 72 only around a portion of its outer surface where it is necessary. The cylindrical outer surface 72 is necessary only where the hinging body 70 interfaces with the spout 74. However, if the hinging body 70 is rigidly attached to the spout 74 or the hinging body 70 is free to rotate with respect to both the spout 74 and the hearth 78, the convex cylindrical surface 72 is necessary wherever the hinging body 70 interfaces with its mating concave cylindrical surface.

In FIG. 7, the length of concave, cylindrical surface 76 formed on the spout 74 subtends an angle $\alpha$. An angle through which hearth 78 is rotated is $\beta$. Therefore, the minimum length of convex, cylindrical surface 72 required on the hinging body 70 should subtend the sum of the angles $\alpha$ and $\beta$. That is, the minimum circumferential length of outer, convex, cylindrical surface 72 required on the hinging body 70 is equal to the arc subtending the sum of the angle ($\beta$) displaced by the hearth 78 during pouring and the angle ($\alpha$) subtended by the interfacing cylindrical surface formed on the spout 74.

Although cylindrical surfaces are preferred on the hinging body and those surfaces which mate with the hinging body surfaces, other surface contours can be used. For example, the surfaces can be frustoconical or spherical. It is only necessary that the surfaces be arcuate about an axis which extends laterally of the channels, that is when viewed in a longitudinal section taken along the channels. The contour of mating surfaces in the direction along the axis is not critical.

While certain preferred embodiments of the present invention have been disclosed in detail, it is to be understood that various modifications may be adopted without departing from the spirit of the invention or scope of the following claims.

I claim:

1. In a casting system which includes a melt overflow apparatus in which a spout for containing molten material has a portion of one wall removed causing the material to overflow out of the spout onto a rotating, heat extracting substrate which is positioned laterally with respect to the spout and positioned in the region where a portion of the spout wall was removed, an improved melt overflow apparatus comprising:

(a) a stationary spout having a channel formed through it, one open end of the channel being adjacent to the outer surface of the substrate for confining the molten material and preventing it from flowing downwardly out of the spout;

(b) a hinging body engaging the spout at one side; and (c) a hearth which engages the hinging body opposite the spout and which is pivotable about the hinging body with respect to the stationary spout.

2. An improved melt overflow apparatus in accordance with claim 1 wherein the hinging body is rigidly attached to the hearth and the hinging body has a convex, arcuate surface which matingly engages, and is rotatable relative to, a concave, arcuate surface formed in the end of the stationary spout opposite the substrate.

3. An improved melt overflow apparatus in accordance with claim wherein the hinging body is rigidly attached to the spout, and the hinging body has a convex, arcuate surface which matingly engages, and is rotatable relative to, a concave, arcuate surface formed in the end of the hearth.

4. An improved melt overflow apparatus in accordance with claim 1 wherein the hinging body has a convex, arcuate surface which matingly engages, and is rotatable relative to, both a concave, arcuate surface formed in the opposite end of the stationary spout from the substrate, and a concave, arcuate surface formed in the end of the hearth.

5. An improved melt overflow apparatus in accordance with claim 2 or 3 or 4 wherein the hinging body has a channel which is transverse to the axis of the hinging body and which is in registration with the spout channel.

6. An improved melt overflow apparatus in accordance with claim 2 or 3 or 4 wherein said arcuate surfaces are cylindrical.

7. An improved melt overflow apparatus in accordance with claim 6 wherein the hinging body has a channel which is transverse to the axis of the hinging body and which is in registration with the spout channel.

8. An improved melt overflow apparatus in accordance with claim 7 wherein the plane of the floor of the channel formed in the hinging body is substantially along diameters of the cylindrical surface of the hinging body.

9. An improved melt overflow apparatus in accordance with claim 7 wherein the plane of the floor of the channel formed in the hinging body is substantially along diameters of the cylindrical surface of the hinging body, the plane of the floor of the channel is at a 45° angle with respect to horizontal in its initial position.

10. An improved melt overflow apparatus in accordance with claim 5 wherein the floor of the channel formed in the hinging body is convex and arcuate in shape and connects two points on the outer surface of the hinging body when looking in section along the axis of the hinging body.

11. An improved melt overflow apparatus in accordance with claim 2 or 3 or 4 wherein, in its operable position, the floor of the channel formed in the spout is angled at a 45° angle with respect to horizontal in its initial position.

12. An improved melt overflow apparatus in accordance with claim 2 or 3 or 4 wherein, in its operable position, the floor of the channel formed in the spout is horizontal in its initial position.

13. An improved melt overflow apparatus in accordance with claim 5 wherein the channel formed in the hinging body is equivalent in axial length to the interior width of the channel formed in the spout and is substantially equal to the width of the strip being cast.

* * * * *